United States Patent [19]

Bains et al.

[11] 4,189,890

[45] Feb. 26, 1980

[54] PANEL JOINT

[75] Inventors: Gurdip S. Bains; Niles J. Martin, both of Bonneauville Borough, Pa.

[73] Assignee: Westinghouse Electric Corp., Pittsburgh, Pa.

[21] Appl. No.: 931,647

[22] Filed: Aug. 8, 1978

[51] Int. Cl.[2] ..... E04C 1/18

[52] U.S. Cl. ..... 52/584; 52/585

[58] Field of Search ..... 52/582, 584, 282, 645, 52/578, 579, 585

[56] References Cited

U.S. PATENT DOCUMENTS

| | | | |
|---|---|---|---|
| 1,964,131 | 6/1934 | Nelson et al. | 52/584 |
| 2,103,152 | 12/1937 | Douglass | 52/578 |
| 2,327,743 | 8/1943 | Rosenberg | 52/586 |
| 2,667,242 | 1/1954 | Kullmer | 52/282 |
| 2,739,677 | 3/1956 | Greulich | 52/578 |
| 2,808,624 | 10/1957 | Sullivan | 52/403 |
| 2,829,018 | 4/1958 | Valtri | 52/584 |
| 2,933,167 | 4/1960 | Keller | 52/580 |
| 2,990,920 | 7/1961 | Hoffman | 52/645 |
| 3,624,694 | 11/1970 | Byland | 52/241 |
| 3,750,410 | 8/1973 | Converse | 52/584 |

FOREIGN PATENT DOCUMENTS

| | | | |
|---|---|---|---|
| 1473644 | 5/1977 | United Kingdom | 52/582 |

*Primary Examiner*—James L. Ridgill, Jr.
*Attorney, Agent, or Firm*—D. R. Lackey

[57] ABSTRACT

A panel joint for joining first and second adjoining, upstanding wall panels such that their front surfaces are in a common plane and the forward facing corners of their adjoining edges are held tightly together. The panel joint includes first and second joint elements fixed to the back surfaces of the first and second wall panels, respectively, adjacent to their adjoining edges. The first and second joint elements each include upstanding leg portions disposed in spaced parallel relation, with one of the leg portions having a flanged end which bridges the spacing and butts against the side of the other leg portion. Clamping devices link the leg portions of the first and second joint elements.

4 Claims, 4 Drawing Figures

PANEL JOINT

BACKGROUND OF THE INVENTION

1. Field of the Invention:

The invention relates in general to panel joints, and more specifically to panel joints for joining two wall panels with their front surfaces in a common plane.

2. Description of the Prior Art:

The assembly of wall panels in the construction of buildings, walls, partitions, elevator cabs, and any other paneled structure, requires simple, low cost, easy to install panel joints. In some installations, the joining hardware is visible as a decorative strip between adjacent panels. When it is not required that the joint hardware be concealed, it greatly simplifies the task of joining the panels, as the strip overlaps the edges of the panels, and thus the panels do not have to butt tightly together in order to provide an effective joint.

In installations wherein the edges of the panels are to be tightly butted together, with the joining hardware concealed, a much more difficult joining problem is presented. The panel joints must be tight, and they must remain tight during usage. The latter requirement is more difficult to achieve when the assembled panels will be subjected to movement and vibration, such as the panels in an elevator cab. It is also important that front surfaces be disposed in a common plane, and the "flatness" of the resulting composite wall must be maintained without any bowing at the joint. This requirement is again especially important to elevator cabs which are subjected to movement and vibration over a period of many years.

Thus, it would be desirable to provide a new and improved panel joint in which the adjoining edges are tightly butted together with concealed hardware. The panel joint must make it easy to obtain the desired alignment of certain edges of the panels, such as their bottom edges, while simultaneously aligning the front surfaces into a common plane, notwithstanding slight differences in the thickness and length dimensions of the panels to be joined. The panel joint must be such that it will not loosen and/or bow through usage, even when used to form panel structures which may be subjected to vibration.

SUMMARY OF THE INVENTION

Briefly, the present invention is a new and improved panel joint which includes first and second joint elements fixed adjacent to adjoining edges of the back surfaces of first and second panel members, respectively, to be joined. The first and second joint elements include first and second upstanding leg portions, respectively, with the first and second upstanding leg portions being disposed in spaced relation with one another, and with the adjoining edges of the first and second panel members. One of the upstanding leg portions includes a flanged end in which the flange extends towards the other leg portion and contacts a side thereof. Clamping means link the first and second leg portions via openings therein at spaced locations along the adjoining edges of the first and second panel members, to hold the first and second panel members in assembled relation. The openings are elongated and oriented transverse to one another in order to provide a first adjustment which enables alignment of the bottom, or the top, edges of the first and second panel members, i.e., a vertical adjustment, and a second adjustment which enables alignment of the front surfaces of the first and second panel members in a common plane, i.e., a horizontal adjustment. The vertical and horizontal adjustments refer to the adjustment directions when the panels are upstanding.

In a preferred embodiment of the invention, one, or both, of the adjoining edges of the first and second panel members, is angled slightly such that when the clamping means is actuated to clamp the adjoining edges of the panel member together, the forward corners of the adjoining edges are forced tightly together, while the rear corners of the adjoining edges are spaced slightly, insuring a tight joint when the panel members are viewed from their front surfaces. Further, the panel joint will align the front surfaces in a common plane, and maintain such alignment, because one of the pressure points of the joint is at the front corners of the adjoining edges, and the other pressure point is spaced from the back surfaces of the panel members.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
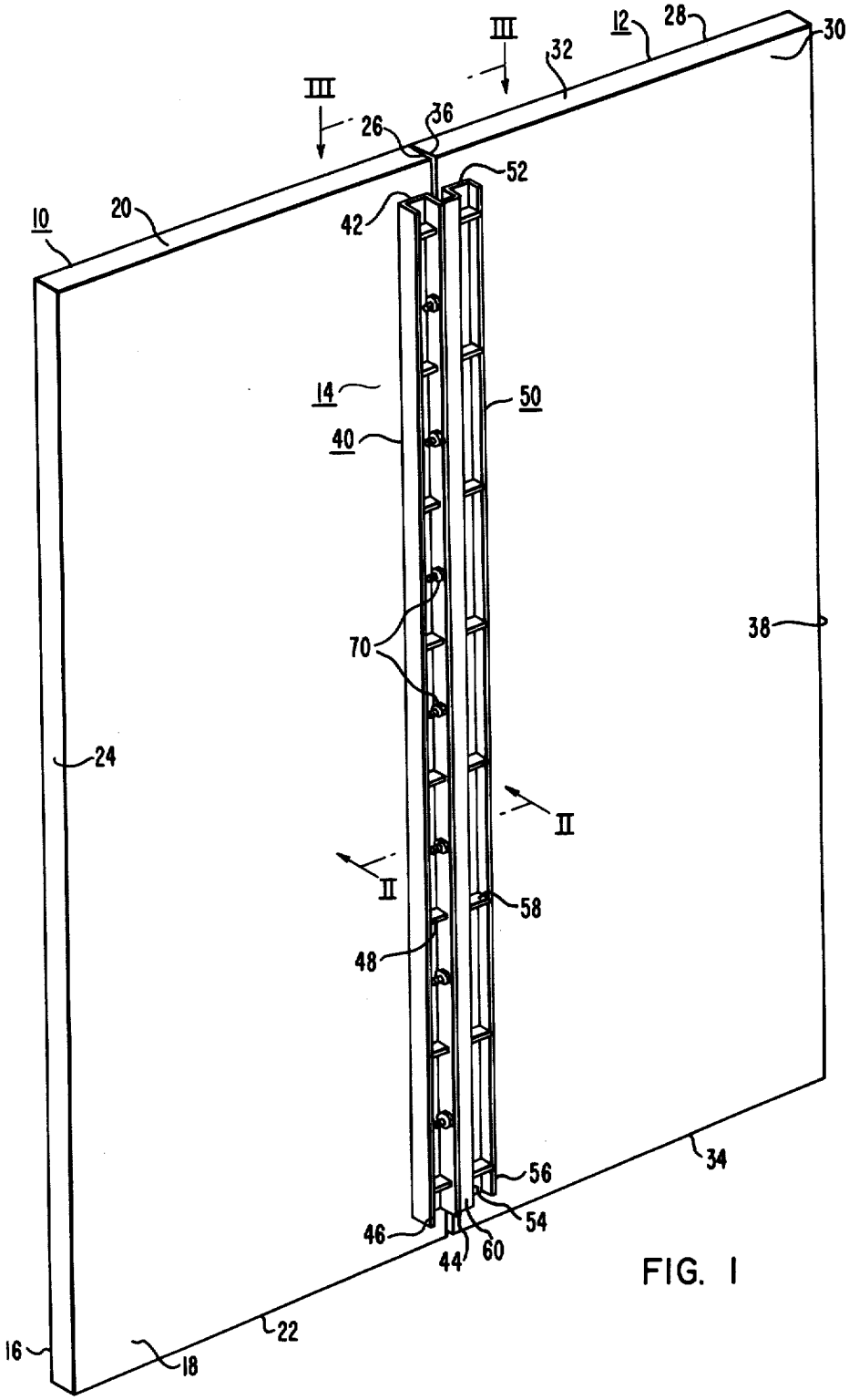
FIG. 1 is a perspective view of first and second upstanding wall panels joined with a panel joint constructed according to the teachings of the invention.
Figure 3:
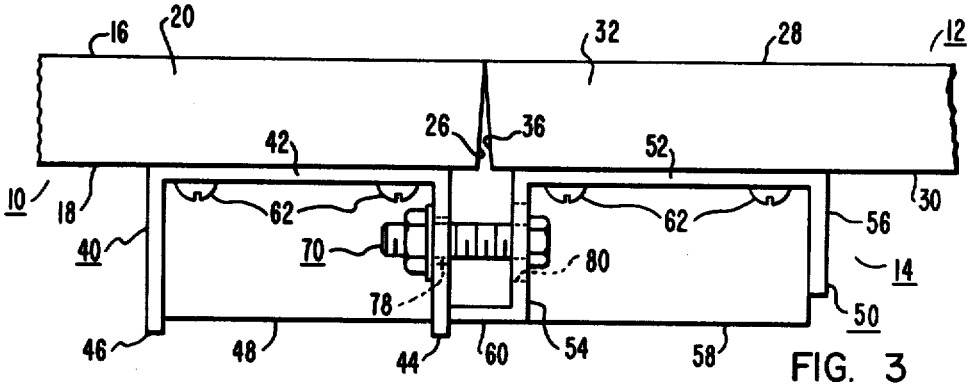
FIG. 3 is a plan view of the panel joint shown in FIG. 1, taken between and in the direction of arrows III—III in FIG. 1.
Figure 2:
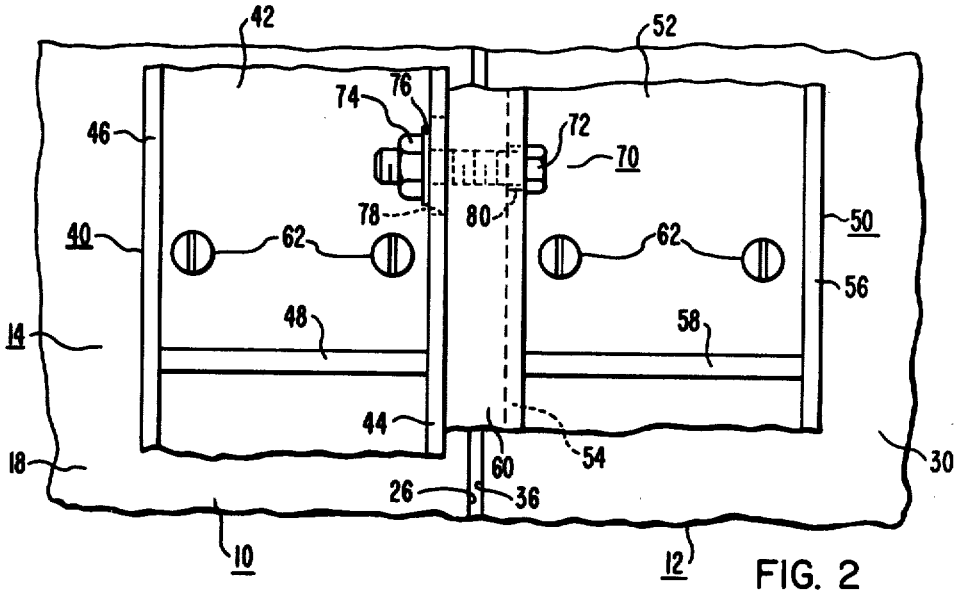
FIG. 2 is a fragmentary elevational view of the panel joint shown in FIG. 1, taken between and in the direction of arrows II—II in FIG. 1.

Referring now to the drawings, FIG. 1 is a perspective view of first and second ajoining, upstanding wall panel members 10 and 12, respectively, which are joined together via a panel joint 14 constructed according to the teachings of the invention. FIGS. 2 and 3 are elevational and plan views, respectively, of joint 14, taken between and in the direction of arrows II—II and III—III, respectively, of FIG. 1. FIGS. 1, 2 and 3 will be collectively referred to when describing the construction of panel joint 14.

Panel member 10, which is preferably formed of a non-metallic material such as wood or plastic, includes front and rear major opposed parallel surfaces 16 and 18, respectively, upper and lower edges 20 and 22, respectively, and first and second side edges 24 and 26, respectively, with the second side edge 26 being an "adjoining" edge relative to panel member 12.

Panel member 12, which will usually be formed of the same material as panel member 10, includes front and rear major opposed parallel surfaces 28 and 30, respectively, upper and lower edges 32 and 34, respectively, and first and second side edges 36 and 38, respectively, with the first side edge 36 being an "adjoining" edge relative to panel member 10.

Panel joint 14 includes first and second elongated joint elements 40 and 50, respectively, and clamping means 70. The first joint element 40 is preferably formed from a rigid metallic channel member having a web portion 42 and first and second upstanding leg portions 44 and 46, respectively, which extend perpendicularly outward from a common side of web portion 42. While only the web and first leg portions 42 and 44 are absolutely essential to the first joint element 40, from the standpoint of the invention, it is highly desirable that the second leg portion 46 be included in order to add rigidity and strength to the first joint element 40. Further, depending upon the gauge of the material of which the channel is formed, it may be desirable to add a plurality of spaced, metallic reinforcing ribs 48 to the channel opening, such as by welding the edges of metallic plates to the inner surfaces of the first and second upstanding leg portions, at selected spaced locations along the length of the channel opening.

The second joint element 50 is preferably formed from a rigid, metallic channel member having a web portion 52, and first and second upstanding leg portions 54 and 56, respectively, which extend perpendicularly outward from a common side of web portion 52. The end of the first leg portion 54 includes an integral flange 60 which extends perpendicularly outward, away from the outer side of leg portion 54. As best illustrated in FIG. 3, the leg portions 44 and 54 are dimensioned such that when the first and second joint elements 40 and 50 are placed in side-by-side relation, the end of flange 60 will contact or butt against the side of leg portion 44. Only the web portion 52 and the first upstanding leg portion 54 with its flange 60 are essential for the second joint element 50, but it is highly desirable that the second leg portion 50 be included for strength, and, similar to the first joint element, reinforcing ribs 58 may be provided in the channel opening.

Joint elements 40 and 50 are secured to the rear surfaces 18 and 30, respectively, of the first and second panel members 10 and 12, respectively, via suitable fastening means such as by a plurality of screws 62. The screws 62 are disposed in spaced relation along the length dimension of the joint elements, in any desired pattern, with suitable openings being provided in the web portions 42 and 52 for receiving the screws 62.

The clamping means 70 clamps the outwardly extending end of flange 60 against the outer side of leg portion 44. As illustrated in the figures, the clamping means 70 is preferably a plurality of nut and bolt assemblies, each of which includes a bolt 72, a nut 74, and a lock washer 76. Leg portion 44 includes a plurality of spaced openings 78, and leg portion 54 includes a plurality of spaced openings 80, with an opening 78 being aligned with opening 80 for receiving a bolt 72. The openings 78 and 80 are elongated, or in the form of slots, with the directions of elongation being transverse to one another in order to provide both horizontal and vertical adjustment of one panel member relative to the other. For example, as best illustrated in FIGS. 2 and 3, openings 78 may have their direction of elongation oriented in a direction which is substantially parallel with the length dimension of the elongated joint element 40, while openings 80 may have their direction of elongation oriented in a direction perpendicular to the length dimension of the elongated joint element 50. The elongated openings 78 and 80 provide both horizontal and vertical adjustment such that the front surfaces 16 and 28 of panel members 10 and 13, respectively, may be oriented in a common plane, and the bottom edges 22 and 34 (or the top edges 20 and 32) may be aligned in a common plane.

Figure 3A:
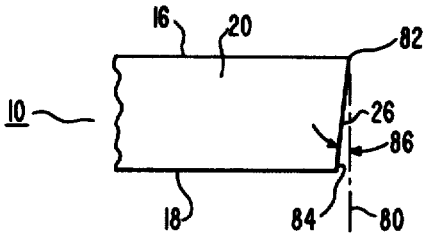
FIG. 3A is a plan view of one of the wall panels shown in FIG. 3, illustrating the construction of a wall panel according to a preferred embodiment of the invention.

In a preferred embodiment of the invention, one or both of the adjoining edges 26 and 36 of panel members 10 and 12, respectively, is angled such that when the front surfaces 16 and 28 of panel members 10 and 12, respectively, are disposed in a common plane with their adjoining edges 26 and 36 adjacent to one another, the only contact between the adjoining edges will be at the forward corners of the adjoining edges, i.e., those corners formed between the front surface and the adjoining edge. For example, as shown in FIG. 3A relative to panel member 10, an imaginary line 80 runs through its forward corner 82, perpendicular to the plane of the front surface 16. Edge 26 starts at forward corner 82 and ends at the rear corner 84, with the surface of edge 26 making a predetermined small angle 86 with imaginary line 80, such as an angle of 3 or 4 degrees. This arrangement insures that the forward corners of the adjoining edges 26 and 36 will be tight. This arrangement also spreads the pressure points of the panel joint, with one pressure point being along the forward edges of the panels, and the other being between the flange 60 and leg 44, insuring that the panels will not bow at the joint.

In the assembly of the panel members 10 and 12, a convenient method involves the steps of placing the panel members on a flat surface, with their front surfaces 16 and 28 facing downwardly. This automatically places the front surfaces of the panels in a common plane. The panels are placed with their adjoining edges 26 and 36 in contact with one another, and selected edges are aligned in a common plane. For example, the lower edges 22 and 34 of panel members 10 and 12, respectively, may be aligned in a common plane. One of the joint elements is then fastened to the rear surface of one of the wall panels, immediately adjacent to the "adjoining" edges thereof, via the fastener means 62. For example, joint element 50 may be fastened to the rear surface 30 of panel member 12. The edge of joint element 50 which defines the outer surface of the first leg portion 54 is spaced back slightly from the rear corner of the adjoining edge 36, by a predetermined dimension. For example, if the joint elements are constructed of steel sheet having a thickness of 0.090 inch, and the flange 60 extends outwardly from leg portion 54 by a dimension of about 0.375 inch, the predetermined spacing of the joint element away from the edge may be about 0.125 to 0.187 inch.

The remaining joint element 40 is then placed on the rear surface 18 of panel member 10, immediately adjacent to edge 26. Joint element 40 is positioned such that the end of flange 60 butts against the side of leg portion 44. The bolts 72 are then inserted through the openings 78 and 80 of leg portions 44 and 54, respectively, the lock washers are placed in position, and the nuts 74 are threadably engaged with the bolt 72, but they are not tightened. The elongated openings 78 and 80, with their transverse directions of elongation, allow the panel members to be aligned as hereinbefore set forth, even with slight differences in the thicknesses and lengths of the panel members.

Joint element 40 is then secured to panel member 10 via the screws or fastener means 62, and the nut and bolt assemblies are then tightened to hold the selected alignment parameters of the panels.

It should be noted that the disclosed panel joint 14 provides a very strong "box-like" structure which resists bowing of the panels at the joint. One of the pressure points (or lines) of the panel joints is immediately adjacent to the front corner of the adjoining edges 26 and 36, assuring a tight joint when the panel members 10 and 12 are viewed from their front surfaces 16 and 28, respectively, and the other pressure point (or line) is spaced away from the rear surfaces 18 and 30 of the panel members 10 and 12, respectively, with this pressure point occurring between the outwardly extending end of the flange 60 and the side of leg portion 44.

In summary, there has been disclosed a new and improved panel joint for joining wall panels in aligned side-by-side relation, with hidden hardware, when viewed from the front surfaces of the panel members. A new and improved panel joint insures a tight joint on the front sides of the panels, the joint will remain tight, even when the panels are subjected to movement and vibration as part of their operating environment, and the box-like structure of the joint insures that the panel members will maintain the selected alignment, without bowing at the joints.

We claim as our invention:

1. A panel joint, comprising:

first and second adjoining, upstanding wall panels having front and rear surfaces and adjacent edges which are to be joined together with the front surfaces of the panels in a common plane, first and second rigid metallic joint elements, said first and second joint elements each having web portions fixed to the rear surfaces of said first and second wall panels, respectively, adjacent to said adjacent edges, said first joint element including an integral first leg portion perpendicular to its web portion and to the rear surface of said first wall panel, which extends along the edge of the first wall panel which adjoins an edge of the second wall panel, said second joint element including an integral first leg portion perpendicular to its web portion and to the rear surface of said second wall panel, which leg portion is in spaced parallel relation with the first leg portion of said first joint element, one of said first leg portions having an integral flanged end perpendicular thereto which extends towards and bridges the space between the other first leg portion, with the outermost edge of said flange contacting the facing side of the other first leg portion, said first leg portions having a plurality of aligned openings located between the flanged end and said web portions, and clamping means including bolts disposed through the aligned openings in the spaced first leg portions of the first and second joint elements, and nuts tightened on said bolts to simultaneously force said flanged end against the facing surface of the leg portion, and to force at least a portion of the adjacent edges of said first and second wall panel members tightly together.

2. The panel joint of claim 1 wherein the adjacent edges of the first and second wall panels have forward corners at the intersection of the edge and front surface, and rear corners at the intersection of the edge and rear surface, and wherein at least the adjacent edge of one of said panels is angled, starting substantially at its forward corner, such that when the front surfaces of the first and second wall panels are in a common plane and the forward corners of the adjacent edges are tightly together, the adjacent edges are spaced apart, except for the contact adjacent to their forward corners, to insure a tight joint between the adjoining edges at the forward corners of the panels.

3. The panel joint of claim 1 wherein the adjacent edges of the first and second wall panels have forward corners at the intersection of the edge and front surface, and rear corners at the intersection of the edge and rear surfaces, and wherein the adjacent edges of both of said first and second panels are angled, starting substantially at their forward corners, such that when the front surfaces of the first and second wall panels are in a common plane and the forward corners of the adjoining edges are tightly together, the adjacent edges are spaced apart, except for the contact adjacent to their forward corners, to insure a tight joint between the adjoining edges at the forward corners of the panels.

4. The panel joint of claim 1 wherein the openings in the leg portions of the first and second joint elements are elongated in first and second different directions, respectively, with said directions being selected to provide both vertical and horizontal adjustments of one wall panel relative to the other.

* * * * *